United States Patent [19]

Herke

[11] 3,995,707

[45] Dec. 7, 1976

[54] WELL DRILLING BIT

[76] Inventor: John Herke, Rte. 5, Box 375, Yakima, Wash. 98902

[22] Filed: Sept. 23, 1975

[21] Appl. No.: 615,975

[52] U.S. Cl. ..... 175/414; 175/417

[51] Int. Cl.[2] ..... E21C 13/08

[58] Field of Search ..... 175/414–418

[56] References Cited

UNITED STATES PATENTS

| | | | |
|---|---|---|---|
| 202,023 | 4/1878 | Grubs | 175/414 |
| 280,543 | 7/1883 | Whitcomb | 175/414 |
| 791,264 | 5/1905 | Hardsocg | 175/417 X |
| 1,483,296 | 2/1924 | Gill | 175/414 X |
| 2,863,639 | 12/1958 | Bredesen | 175/414 |
| 3,283,837 | 11/1966 | McKain | 175/414 |

FOREIGN PATENTS OR APPLICATIONS

| | | | |
|---|---|---|---|
| 135,917 | 4/1880 | France | 175/414 |

*Primary Examiner*—Ernest R. Purser
*Assistant Examiner*—Richard E. Favreau
*Attorney, Agent, or Firm*—Clarence A. O'Brien; Harvey B. Jacobson

[57] ABSTRACT

A well drilling bit of generally circular transverse cross-section and generally in the form of an elongated, generally cylindrical metal bit which tapers slightly outwardly toward its lower end with the lower end having a slight outward flare around the periphery thereof. A pair of diametrically opposed water courses in the form of longitudinal grooves extend from the lower end of the bit to a point adjacent the upper end thereof with the upper end of the bit having a screw threaded connection to the jar. The lower end of the bit is provided with a plurality of substantially parallel ridges and grooves in which the two center ridges are slightly higher than the others and the bottom end surface of the bit is slightly concave from edge to edge along the length of the ridges and valleys.

s, 4 Drawing Figures

WELL DRILLING BIT

BACKGROUND OF THE INVENTION

1. Field of the Invention

The present invention generally relates to a well drilling bit for penetrating various types of earth formations in which the bit has a unique ridge and groove or valley construction on the lower end thereof for more effective penetration of earth formations.

2. Description of the Prior Art

Drill bits of the percussion type are generally well known and usually involve a generally cylindrical, elongated heavy drill member connected to a drill stem, bar, jar or the like that is cyclically elevated and released by a machine at the ground surface. The lower end of the drill bit has a particular structural formation to facilitate penetration of various earth formations during cyclic lifting and dropping. Drill bits of this type usually have transverse teeth on the lower end and channels or water courses along each side and a slight outward flare which includes about a 2-inch long wearing surface and a hard surface area adjacent the teeth. One example of this type of bit that is known in the prior art is illustrated in U.S. Pat. No. 3,283,837, issued Nov. 8, 1966. Other prior patents which disclose various types of bits generally of this type are shown in U.S. Pat. Nos. 49,065, issued Aug. 1, 1865; 129,407, issued July 16, 1872; 1,483,296, issued Feb. 12, 1924, and 1,764,989, issued June 17, 1930.

SUMMARY OF THE INVENTION

An object of the present invention is to provide a drill bit having a unique ridge and valley construction to provide a plurality of cutting edges with the ridges which define the cutting edges being parallel to each other across the face of the bit and having the two central ridges for cutting edges raised above the others with the entire outline of the face transversely of the ridges or cutting edges being generally convex.

Another object of the present invention is to provide a bit in accordance with the preceding object in which the ridges or cutting edges and the entire outline of the cutting end of the bit is generally concave along the length of the ridges or edges so that the cyclic reciprocation of the bit which will cause rotation thereof when dropped onto the earth formation being penetrated will render the cutting and drilling operation more efficient since the rotation of the bit due to normal slack in the lifting mechanism will more effectively pulverize rock or other similar earth formations in its course thereby providing greater drilling speeds and less frequent bit dressing.

A further object of the invention is to provide a well drilling bit in accordance with the preceding objects in which the lower end thereof is slightly outwardly flared and water courses or channels are provided along the longitudinal length of the bit and which intersect with the drill face of the bit in remote relation to the two higher central ridges or cutting edges.

A further object of the present invention is to provide a well drilling bit in which the two higher central ridges or cutting edges may be provided by higher ridges flanked by shorter ridges or ridges of substantially the same length oriented in an arc from edge to edge of the bit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
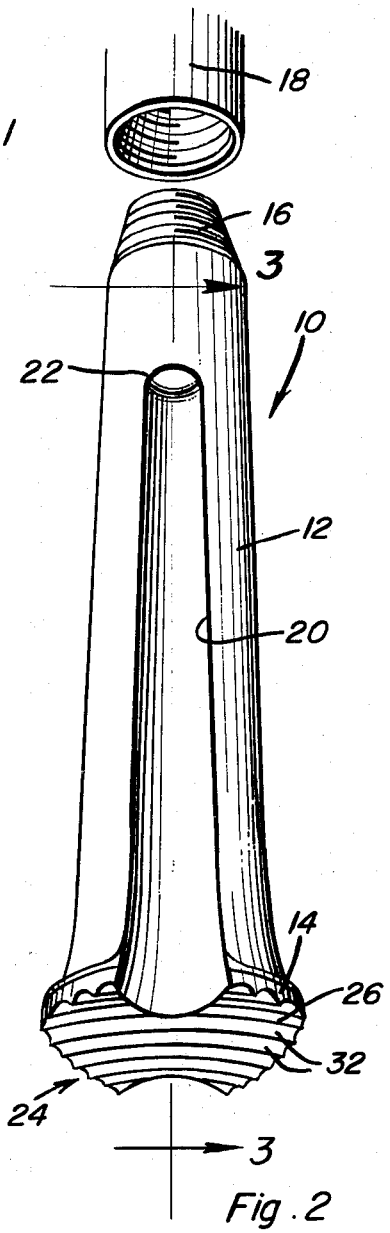
FIG. 1 is a perspective view of the well drilling bit of the present invention.

The well drilling bit of the present invention is generally designated by reference numeral 10 and includes an elongated, generally cylindrical member 12 of solid metallic construction having a slight longitudinal taper with an increase in diameter toward the lower end although the bit may be completely cylindrical from end to end if desired with the exception that the lower end of the member is slightly outwardly flared as indicated by numeral 14. Also, the upper end of the drill bit 10 is provided with a male tapered thread 16 for connection with the internally threaded lower end of a drill stem 18 which may be in the form of a bar, tubular pipe and is sometimes referred to as a jar.

Extending longitudinally of the cylindrical body or member 12 is a pair of diametrically opposed channels 20 which are in the form of water courses and extend substantially throughout the length of the member 12 with the upper end thereof tapering outwardly as indicated at 22 to merge with the periphery of the drill bit 10 and the lower end thereof communicating with the cutting end or bottom end of the drill bit in which the cutting end is generally designated by numeral 24 and which forms the essential components of the invention inasmuch as the specific construction of the water courses 20, the threaded connection 16 and the cylindrical configuration of the drill bit is generally well-known.

Figure 3:
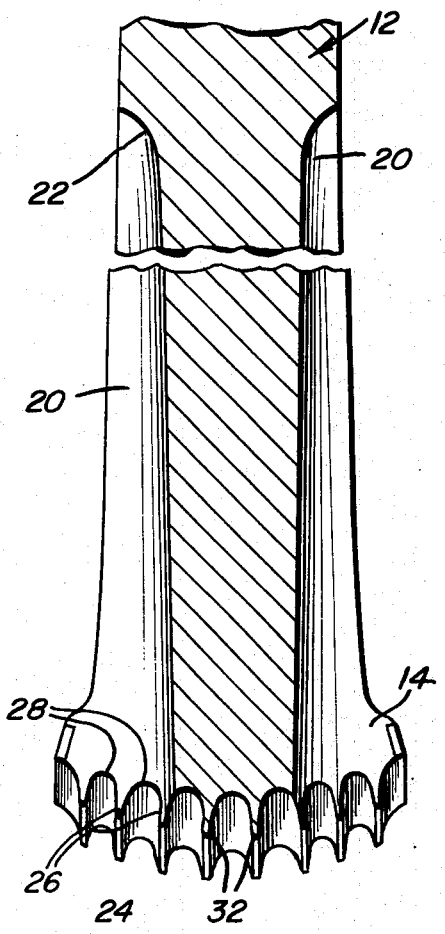
FIG. 3 is a longitudinal, sectional view taken substantially along a plane passing along section line 3—3 on FIG. 1.
Figure 2:
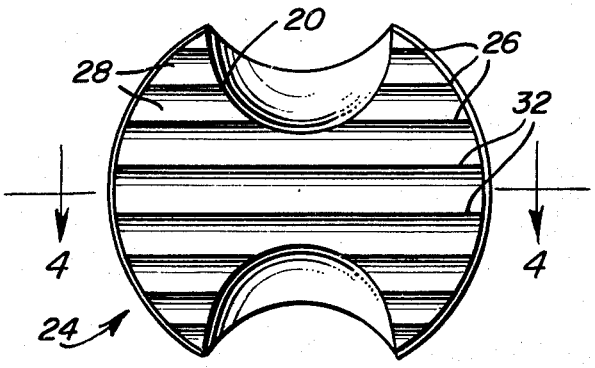
FIG. 2 is an end elevational view thereof.

The cutting end 24 of the drill bit includes a plurality of parallel, transverse ridges or teeth 26 formed therein which are separated by valleys 28 which are correspondingly parallel with the ridges of teeth 26 defining cutting edges. The two centrally disposed ridges or teeth are designated by numeral 32 and project axially beyond all of the adjacent ridges or cutting teeth 26 as illustrated in FIG. 3. Also, as illustrated in FIG. 3, the teeth adjacent to the two center teeth or ridges have their axial outer edges oriented in an arcuate line defining a convex curve transversely of the teeth. The parallel configuration of the ridges and valleys is illustrated in FIG. 2 and the valleys 28 are arranged along an arcuate line in the same manner as the ridges 26 so that, in effect, the two center ridges 32 extend axially beyond the adjacent ridges with the adjacent ridges progressively terminating axially inwardly in relation to the ridges 32.

Figure 4:
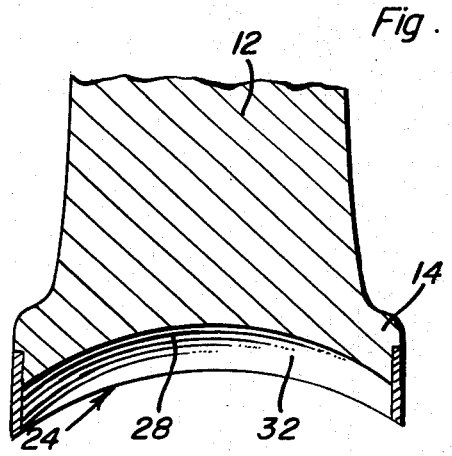
FIG. 4 is a fragmental sectional view taken along section line 4—4 on FIG. 2.

The parallel, transverse ridges 26 and 32 and the valleys 28 therebetween are curved in a generally convex manner as illustrated in FIG. 3 along section line 3—3 and the ridges and valleys are curved in a concave manner when considering the ridges from end to end as illustrated in FIG. 4.

When using the bit, it will naturally rotate during the lifting and descending cycle with the teeth or ridges effectively pulverizing rock in its course with the drill speed being greater with less frequent bit dressing. The flared lower end of the bit is formed by the dressing apparatus which involves the shaping and deformation of the face of the drill bit by the use of a hammering technique. The hardened portion 14 of the bit is hardened by using a surface material provided with barium.

The cutting face of the drill bit is formed by a die which has correspondingly shaped ridges or teeth and recesses or valleys which is in the form of a hammer that reciprocates in relation to the drill bit. The hammer is laterally stationary while the bit swings in an arc at the face being dressed. The concavity is caused by greater impact of the hammer at the center of the face of the bit than at the outer edges. The concavity extends from end to end of the ridges on the drill bit. The structure of the hammering die and the bit dressing apparatus is disclosed in a co-pending application Ser. No. 635,844, filed Nov. 28, 1975.

The specific structural details of the cutting surface defined by the ridges 26 and 32 and the valleys 28 enable a greater drilling speed with the concavity tending to maintain the drill bit in a straight line since the material being drilled is first engaged by the peripheral edge portions of the drill bit and due to the concavity toward the center, such material will tend to move inwardly with respect to the longitudinal aspects of the ridges whereas the convexity of the ridges as observed transversely of the ridges, in FIG. 3, will cause the material to move outwardly in the valleys 28 toward the next adjacent ridge when the drill bit comes into contact with the material being drilled thereby providing a greater movement to the material being drilled and providing more effective pulverization of the material.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A well drilling bit adapted to be cyclically lifted and lowered to drill through an earth formation comprising an elongated vertical body having a lower outwardly flared end having a cutting face thereon for engagement with the earth formation, said cutting face being generally circular in configuration and having a plurality of parallel alternately arranged ridges and valleys extending transversely thereof and occupying substantially the entire area thereof, each of said ridges and valleys being disposed in a single vertical plane and having a constant cross-sectional dimension from end to end, said ridges and valleys being concavely curved from end to end and the axially outer edges of the ridges and the axially innermost surfaces of the valleys being oriented in a convex pattern in transverse section, the two centermost ridges being continuous from end to end and extending axially outwardly beyond the plurality of ridges to each side of the two centermost ridges.

2. The structure as defined in claim 1 wherein said body is generally of cylindrical configuration and provided with a pair of diametrically opposed, longitudinally extending channels, said channels having their lower ends intersecting the cutting face and intersecting all of the ridges except for the two centermost ridges, whereby the plurality of ridges to either side of the two centermost ridges are interrupted by the channels.

3. The structure as defined in claim 2 wherein each of said channels is generally semi-cylindrical in cross-sectional configuration with the innermost portion of each channel intersecting the valley immediately adjacent and laterally outwardly of a centermost ridge.

* * * * *